US009633527B2

(12) United States Patent
Berman

(10) Patent No.: US 9,633,527 B2
(45) Date of Patent: Apr. 25, 2017

(54) ALLOCATION OF VARIABLE AWARD IN GAMING DEVICES

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 355 days.

(21) Appl. No.: 14/462,535

(22) Filed: Aug. 18, 2014

(65) Prior Publication Data

US 2016/0049050 A1 Feb. 18, 2016

(51) Int. Cl.

| | |
|---|---|
| ***G07F 17/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3244* (2013.01); *G07F 17/3267* (2013.01)

(58) Field of Classification Search

CPC ..... G07F 17/32; G07F 17/34

See application file for complete search history.

(56) References Cited

U.S. PATENT DOCUMENTS

| | | | |
|---|---|---|---|
| 5,100,137 | A | 3/1992 | Fulton |
| 5,848,932 | A | 12/1998 | Adams |
| 5,868,619 | A | 2/1999 | Wood et al. |
| 5,947,820 | A | 9/1999 | Morro et al. |
| 5,976,015 | A | 11/1999 | Seelig et al. |
| 6,059,289 | A | 5/2000 | Vancura |
| 6,070,873 | A | 6/2000 | Perkins |
| 6,159,098 | A | 12/2000 | Slomiany et al. |
| 6,168,520 | B1 | 1/2001 | Baerlocher et al. |
| 6,186,894 | B1 | 2/2001 | Mayeroff |
| 6,190,255 | B1 | 2/2001 | Thomas et al. |
| 6,312,334 | B1 | 11/2001 | Yoseloff |
| 6,315,660 | B1 | 11/2001 | Demar et al. |
| 6,565,436 | B1 | 5/2003 | Baerlocher |
| 6,599,192 | B1 | 7/2003 | Baerlocher et al. |
| 6,620,045 | B2 | 9/2003 | Berman et al. |
| 7,704,142 | B2 | 4/2010 | Berman |
| 8,210,932 | B2 | 7/2012 | Shiraishi |

FOREIGN PATENT DOCUMENTS

| | | | |
|---|---|---|---|
| GB | 2210191 | A | 6/1989 |

*Primary Examiner* — Reginald Renwick

(57) ABSTRACT

Embodiments of the present invention set forth systems, apparatuses and methods for allocating variable awards in gaming devices. Accordingly, a gaming device can be configured to provide a variable award that is allocated over a variety of selectable play options. Each of the selectable play options has distinguishing play characteristics that provide different game play while maintaining a substantially similar expected outcome value to the other selectable play options.

14 Claims, 7 Drawing Sheets

ALLOCATION OF VARIABLE AWARD IN GAMING DEVICES

FIELD OF THE INVENTION

This disclosure relates generally to games, and more particularly to systems, apparatuses and methods for allocating variable awards in gaming devices.

BACKGROUND

Casino games such as poker, slots, and craps have long been enjoyed as a means of entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate allocation of variable awards in gaming devices. Accordingly, a gaming device can be configured to provide a variable award that is allocated over a variety of selectable play options. Each of the selectable play options has distinguishing play characteristics that provide different game play while maintaining a substantially similar expected outcome value to the other selectable play options.

In some embodiments, a variable award may be an award of a number of free spins. The number of free spins may be based on an outcome in a primary gaming event or may be selected at random. Multiple selectable play options are then presented where each of the selectable play options is associated with a different multiplier. The number of free spins awarded may then be allocated in each of these selectable play options to maintain a substantially similar expected outcome value of the award. In this embodiment, the number of free spins may be divided by each multiplier respectively associated with the selectable play options to provide a modified numbers of free spins for each selectable play option. In some embodiments, when the number of free spins in not evenly divisible by a multiplier associated with a selectable play option, a remainder is determined and made a part of that selectable play option. The remainder may be additional free spins played at a lower multiplier value, credit values, bonus picks, modified reels, or any other bonus addition or modification that keeps the expected outcome value of the selectable play option at a consistent level with the expected outcome values of the other selectable play options.

DETAILED DESCRIPTION

Figure 1:
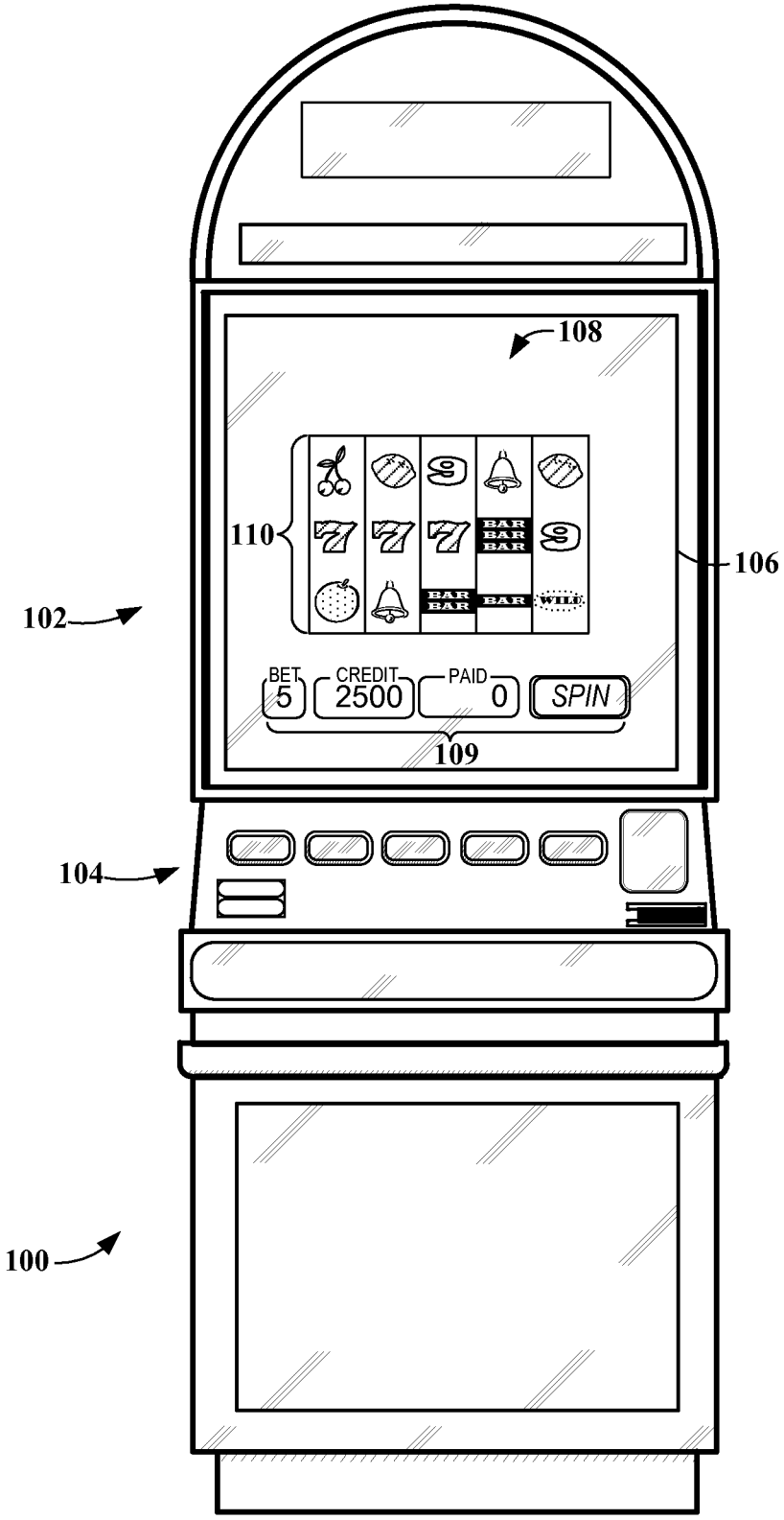
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities by allocating variable awards over selectable play options. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that utilizes operations of allocating variable awards over selectable play options. The variable awards may be triggered from play of a primary or base gaming event, may be determined at random, or may be conditioned on one more predefined criteria being satisfied during game play of a gaming device. Variable awards may differ from static awards in that they provide an award aspect that varies depending on conditions related to the variable awards. The awards may be contrasted with static bonus awards where it is only possible to trigger the bonus in one or a few defined configurations. For example, typical static bonus events may be triggered by three bonus symbols appearing on the game reels, or even where 3, 4, or 5 bonus symbols appear on the screen. Here, it may only be possible to have 3 (or 3, 4, or 5) symbols on the screen at one time to trigger the bonus event (or where additional bonus symbols do not influence or cause the bonus event to be different), and where each configuration is associated with defined bonus parameters. Variable awards, on the other hand, may be triggered in similar fashions but have variable award parameters, such as a variable number of free games associated with a bonus trigger. Alternatively, variable awards may be triggered by many different occurring triggering symbol conditions or orientations that give rise to different bonus parameters based on the triggering conditions.

The multiple play options may have defined characteristics or features over which the variable award is allocated. That is, these characteristics or features may influence the allocation of the variable awards over the various play options. These play options may provide selectable options in executing the bonus. Below are several embodiments and variations of this concept, although many other variations are part of the scope of the invention even if not expressly detailed in the illustrated embodiments.

In some embodiments, a variable award may be an award of a number of free spins. The number of free spins may be based on an outcome in a primary gaming event or may be selected at random. Multiple selectable play options are then presented where each of the selectable play options is associated with a different multiplier. The number of free spins awarded may then be allocated in each of these selectable play options to maintain a substantially similar expected outcome value of the award. In this embodiment, the number of free spins may be divided by each multiplier respectively associated with the selectable play options to provide a modified numbers of free spins for each selectable play option. In some embodiments, when the number of free spins is not evenly divisible by a multiplier associated with a selectable play option, a remainder is determined and made a part of that selectable play option. The remainder may be additional free spins played at a lower multiplier value, credit values, bonus picks, modified reels, or any other bonus addition or modification that keeps the expected outcome value of the selectable play option at a consistent level with the expected outcome values of the other selectable play options.

In other embodiments the variable award may be linked to the number of picks a player has in a pick bonus. For example, a pick screen with a hundred selectable icons may be presented where the player can win between 20 and 50 picks (i.e., the variable award). Multiple selectable play options may be presented with predefined multipliers, where the number of picks is allocated within each selectable play option. For instance, if the player is awarded 45 picks, the selectable play options may provide three choices of: 1) Taking 45 picks of the pick screen with a "1×" multiplier; 2) Taking nine picks of the pick screen with a "5×" multiplier; or 3) Taking four picks with a "10×" multiplier and one pick with a "5×" multiplier. Note that in option #3, since the number of picks is not evenly divisible by "10," the remainder number of picks is allocated with a different multiplier value so that each of the options has a substantially similar expected outcome value. Here, the remainder pick was given a single pick at "5×." However, in other embodiments, the remainder could be given as five additional picks at "1×." There are numerous methods in making these allocations to provide a substantially similar expected outcome value among all of the play options.

While the remainder in the above example is given as additional picks (or free spins, or other game events in other embodiments) at a lower multiplier value, remainders can be allocated in a variety of manners. For example, in various embodiments, remainder may include one or more of free spins/additional picks/additional game events at a lower multiplier, a credit value, a credit award selected from a range of possible credit awards, one or more spins of a bonus wheel, modification of the reels in the free spins/modification of the pick values in a pick screen/modification of additional game events, or any other game event or modification that provides for a substantially identical expected outcome value among the play options.

In general terms, the following could be used:

n=the number of free spins awarded (or picks, etc.)

$p_1, p_2, p_3, p_4 \ldots p_x$=features or characteristics of selectable play options $m_1, m_2, m_3, m_4 \ldots m_x$=predefined multipliers or other play event characteristic $g_1, g_2, g_3, g_4 \ldots g_x$=number of free spins (or picks, etc.) associated with the corresponding play option $r_1, r_2, r_3, r_4 \ldots r_x$=remainders associated with the corresponding play option where:

$p_1 \rightarrow n/m_1 = g_1 + r_1$ (in some cases $m_1$ is the lowest possible multiplier—thus, $g_1$=n and $r_1$=0)

$p_2 \rightarrow n/m_2 = g_2 + r_2$ $p_3 \rightarrow n/m_3 = g_3 + r_3$ $p_4 \rightarrow n/m_4 = g_4 + r_4$ $p_x \rightarrow n/m_x = g_x + r_x$ These representative formulas show process steps and equivalency between the characteristics/features and the representation of them. These determinations or calculations may be implemented dynamically during game play or may be implemented at a game setup stage where each result is coded in a lookup or other type of table or database. While division is shown as a method of generating these values or characteristics of each selectable play option, other techniques may be used depending on the nature of the allocation and game/bonus event and nature of the remainder presented with the game play options.

Figure 4:
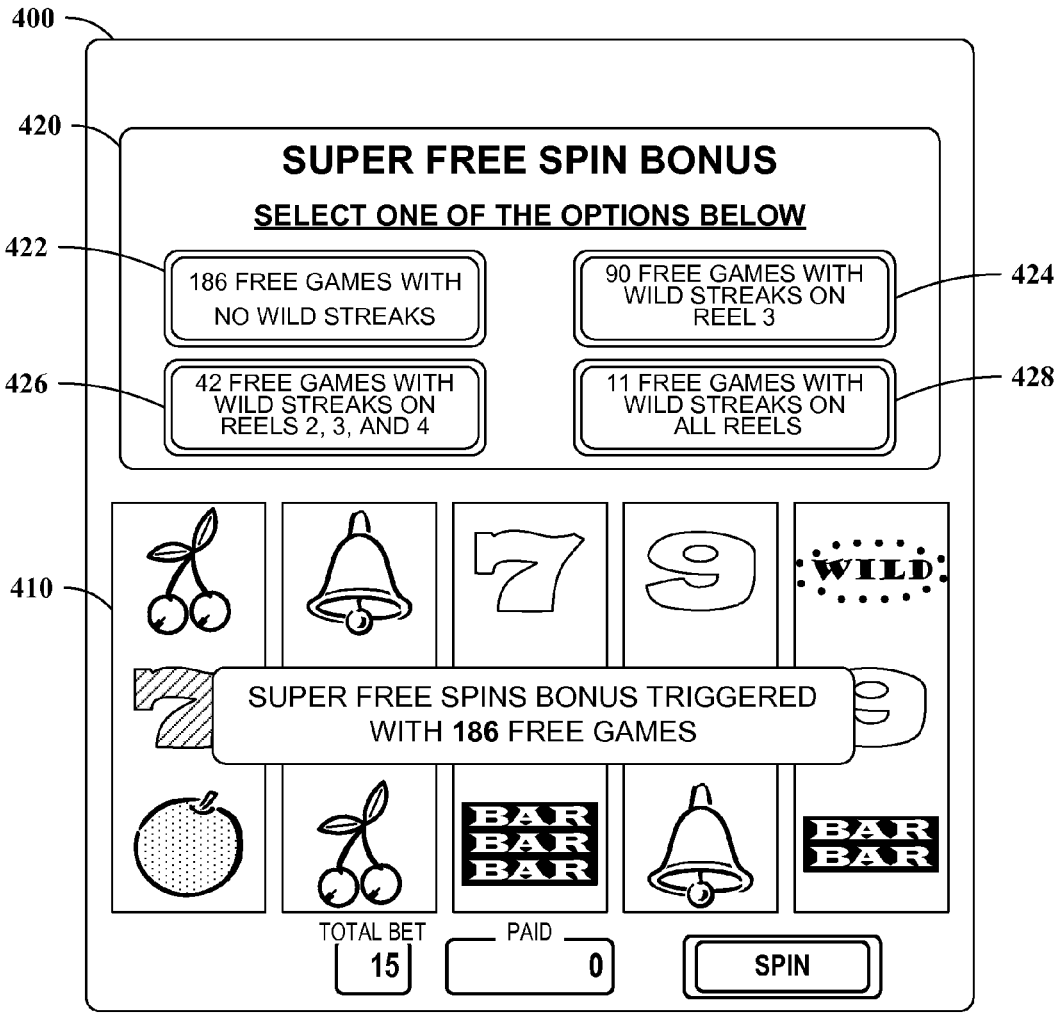
FIG. 4 is a detail diagram of a display on a gaming device configured to allocate variable awards according to embodiments of the invention.

Although variable awards of free spins or picks are used as example embodiments above, this concept covers any allocation of variable awards over multiplier play options. For example, characteristics of a bonus may be changed within a fixed number of free spins in a bonus event. Here, for instance, a free spin bonus of 16 free games may be used where a play option may include the distribution of wild symbols, special symbols, multiplier values, or other features within the reels or free games over the set number of free spins. Similarly, the characteristic or feature of the various play options that cause the allocation can vary. For example, these characteristics may be multiplier values, reel compositions, number of reels, additional/less pays in a paytable, presence or actions of special symbols, etc. Thus, while many of the embodiments are discussed where the defining characteristic of the play options is a multiplier value, other characteristic types may be used to drive the allocation process of the variable award (such as seen in FIG. 4).

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

Figure 2:
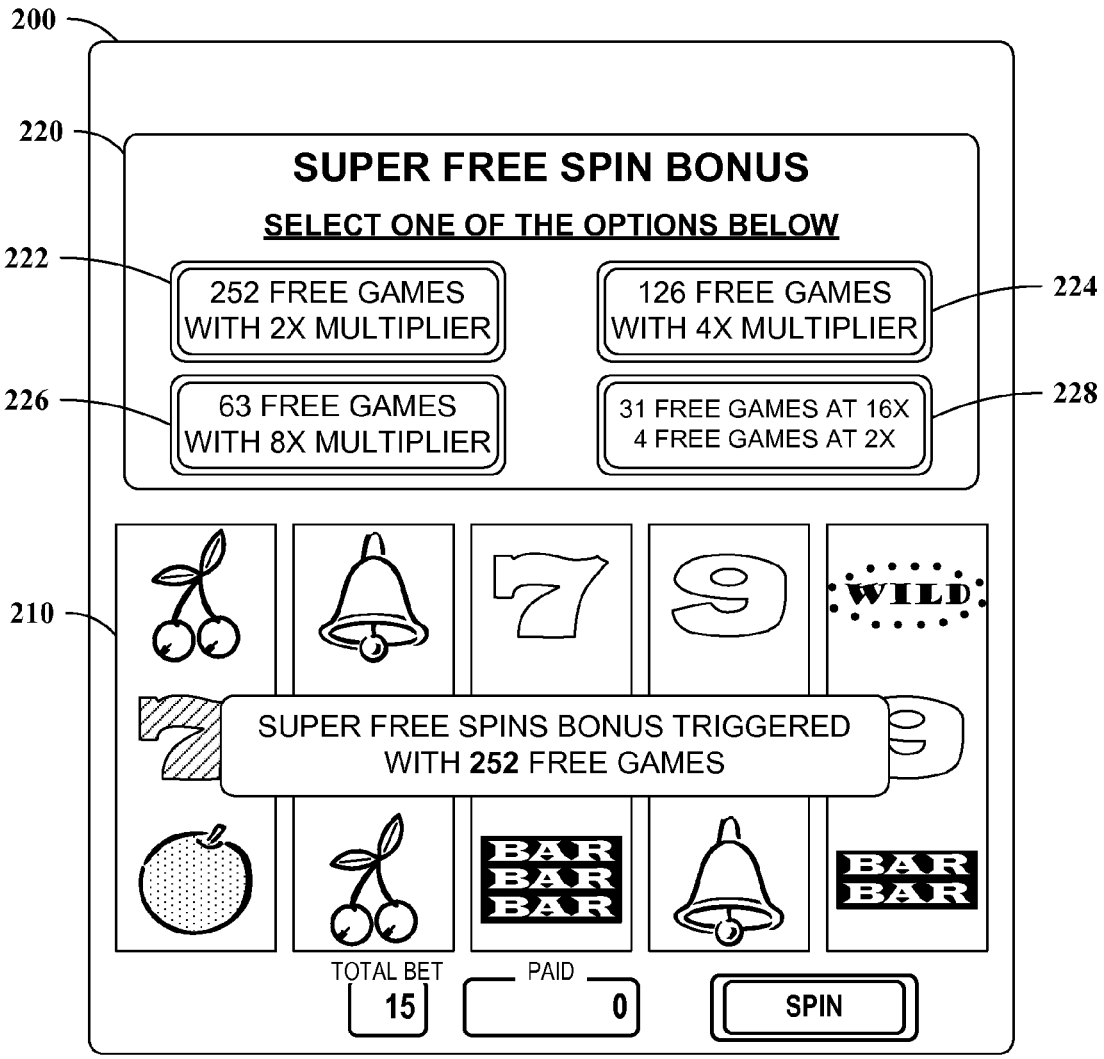
FIG. 2 is a detail diagram of a display on a gaming device configured to allocate variable awards according to embodiments of the invention.
Figure 3:
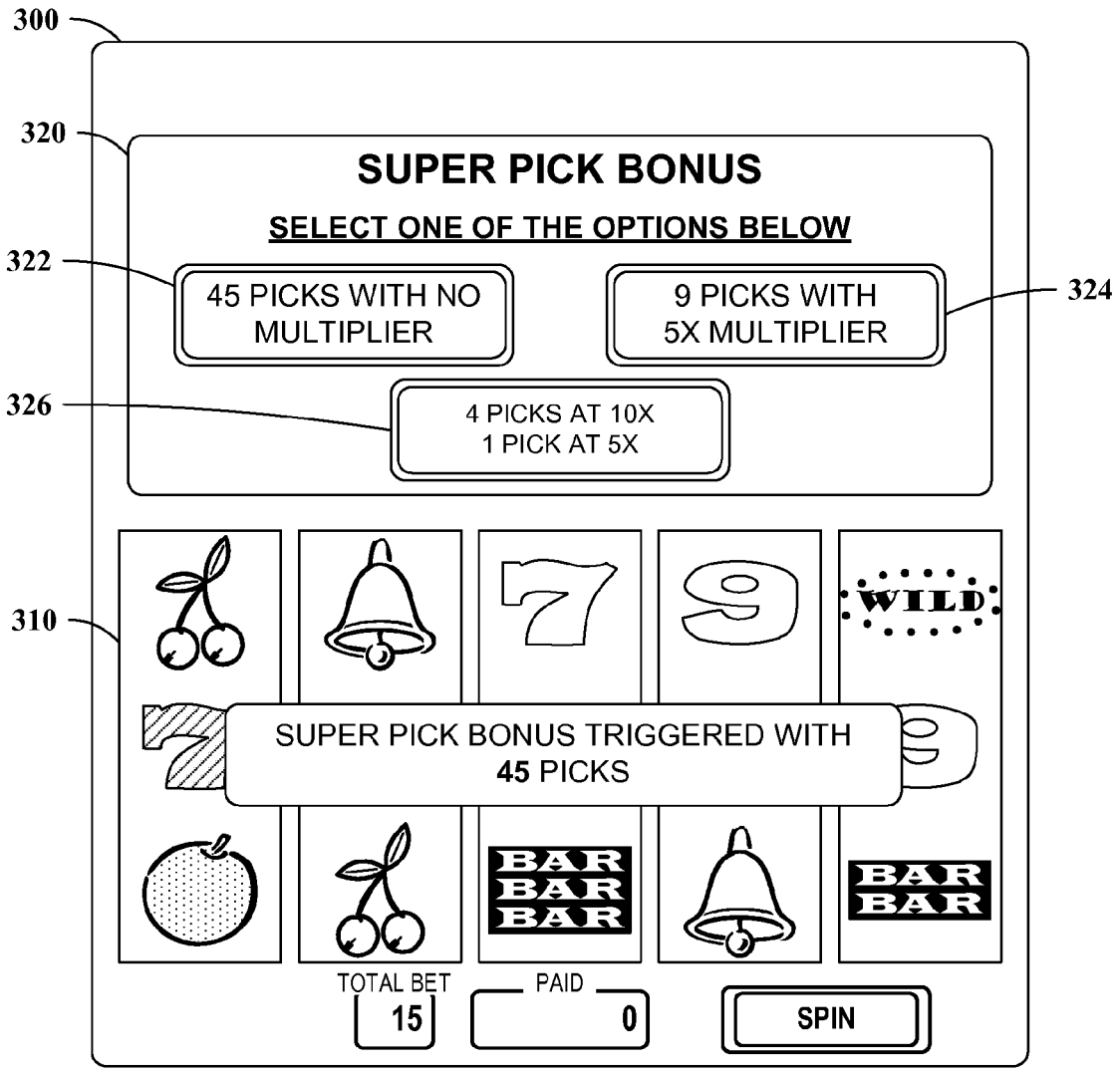
FIG. 3 is a detail diagram of a display on a gaming device configured to allocate variable awards according to embodiments of the invention.

FIGS. 2, 3, and 4 are detail diagrams of gaming displays showing example embodiments utilizing techniques of allocating variable awards in gaming devices. Referring to FIG. 2, a gaming display 200 includes a game play portion 210 and a messaging portion 220. In some embodiments, the messaging portion may overlap or cover the game play portion 210 when a message is to be displayed to a player. As shown in FIG. 2, a player has triggered a free spin bonus event and is presented with several (four) play options 222, 224, 226, 228. Here the player has been awarded 252 free spins based on a result of a primary game event played on the game play portion. The number of free spins is a variable award amount and in this embodiment is dependent on the specific outcome in the primary gaming event.

This number of awarded free spins is allocated over the four play options, which are implemented as selectable icons in the messaging portion 220 of the game display 200 as follows. In the first selectable play option 222, the player can take the awarded 252 free games at a "2×" multiplier. That is, any winning symbol combinations received in any of the 252 free spins or games will be multiplied by two. In the second selectable play option 224, the player can take 126 free spins at a "4×" multiplier. Here, the 252 awarded free spin number is simply divided by two to reflect the two-fold increase in multiplier value. This means that the allocation of free spins in the second selectable play option 224 remains math neutral with the first selectable play option. That is, the first and second play options have the same expected outcome value.

In the third selectable play option 226, a player can take 63 free spins at an "8×" multiplier. In the fourth selectable play option 228, a player can take 31 free spins at a "16×" multiplier and 4 free spins at a "2×" multiplier. Since 252 is not evenly divisible by 8, a remainder value must be used in the allocation of the variable number of free spins. In this embodiment, the remainder takes the form of additional free games at a lower award amount. In some embodiments, these additional free games are allocated at the lowest multiplier (or other feature) value. This technique is utilized in this embodiment as the remainder is set out as four additional free spins played at a "2×" multiplier. However, in other embodiments, the next multiplier down may be used instead of going immediately to the lowest multiplier value. Thus, in other embodiment, the fourth selectable play option may have given the player 31 spins at a "16×" multiplier and 1 additional free spin at an "8×" multiplier.

In other embodiments, if a bonus is retriggered during free spin game events, the additional free spins awarded may be awarded at a current multiplier level or may be allocated at a different multiplier value depending on the game rules. For example, suppose that after a free game spin at "8×" begins, a player has 15 spins at "8×" remaining, with a remainder of 3 spins at "2×." On this spin, the player retriggers with 15 additional spins, which are awarded at "8×." This may just lead to the player having 23 spins at "8×" with a remainder of 3 at "2×," but there is no inherent reason that this need be the case. The player may instead be awarded 60 spins at "2×," 30 at "4×," or 7 at "16×" with a remainder of 1 at "2×."

Additionally, it may be the case that all retriggered free spins are awarded at "2×," regardless of the current multiplier (this might happen if free spins became more likely at higher multipliers). In this case, it may be that the player is awarded 15 spins at "2×," which would then result in 26 remaining at "8×" with a remainder of 6 at "2×" (this remainder may not be possible when the bonus is initially triggered).

FIG. 3 uses a similar set up to the embodiment shown in FIG. 2 as far as triggering a bonus event. However, the embodiment in FIG. 3 uses a pick bonus as the bonus event and gives the player only three play options. Referring to FIG. 3, a game display 300 includes a game play portion 310 and a messaging portion 320. Here, the messaging portion 320 displays three selectable play options 322, 324, 326 when a bonus event is triggered. The first selectable play option 322 is to make 45 picks or selections of items in a pick screen, but with none of the values won being multiplied. The second selectable play option 324 allows the player to make 9 picks, where each credit value of the picks or selections being multiplied by a "5×" multiplier. As with the embodiment shown in FIG. 2, this allocation of picks reflects the associated multiplier value of the second play option while maintaining a substantially similar (in this case identical) expected outcome value for the bonus gaming event. In the third selectable play option 326, the player may take 4 picks at a "10×" multiplier and 1 pick at a "5×" multiplier. As described above, this third selectable play option 326 could have allocated the picks as 4 picks at a "10×" multiplier and 5 picks with no multiplier value while retaining the same expected outcome value for the bonus gaming event.

FIG. 4 shows another similar bonus event where a variable award is allocated over multiple play options. In the embodiment shown in FIG. 4, the variable free games awarded are allocated in view of play options having different reel characteristics used in implementing the free spins. Referring to FIG. 4, a game display 400 includes a game play portion 410 and a messaging portion 420. Here, the messaging portion 320 displays four selectable play options 422, 424, 426, 428 when a bonus event is triggered. The characteristics of each play option are associated with a differing structure of "wild streaks." In this instance, "wild streaks" are five consecutive blocks of wild symbols that are implemented in the reel strips according to rules or features associated with each play option. In the first selectable play option 422, a player can take 186 free spins with no wild streaks added in the reels. In the second selectable play option 424, a player can take 90 free spins with wild streaks on reel 3. In the third selectable play option 426, a player can take 42 free games with wild streaks on reels 2, 3, and 4. In the fourth selectable play option 428, a player can take 11 free spins with wild streaks on all five reels. Note that the number of free spins is not linear among the selectable play options 422, 424, 426, 428 as it was for the multiplier values. This is because the implementation of additional wild streaks on certain reels has a non-linear effect on the expected outcome value of each play option. Hence, the number of free spins for each selectable play option 422, 424, 426, 428 is calculated to achieve a substantially similar expected outcome value for each of the selectable play options. If substantially similar expected outcome values cannot be achieved by only manipulating the allocation of free spins, other remainder techniques may be used to maintain a consistent expected outcome value across all of the selectable play options 422, 424, 426, 428. For example, a random credit value in a range making up the difference in the expected outcome values may be used to augment the free spins allocation. Various other techniques may also be used along the lines discussed above.

Figure 5:
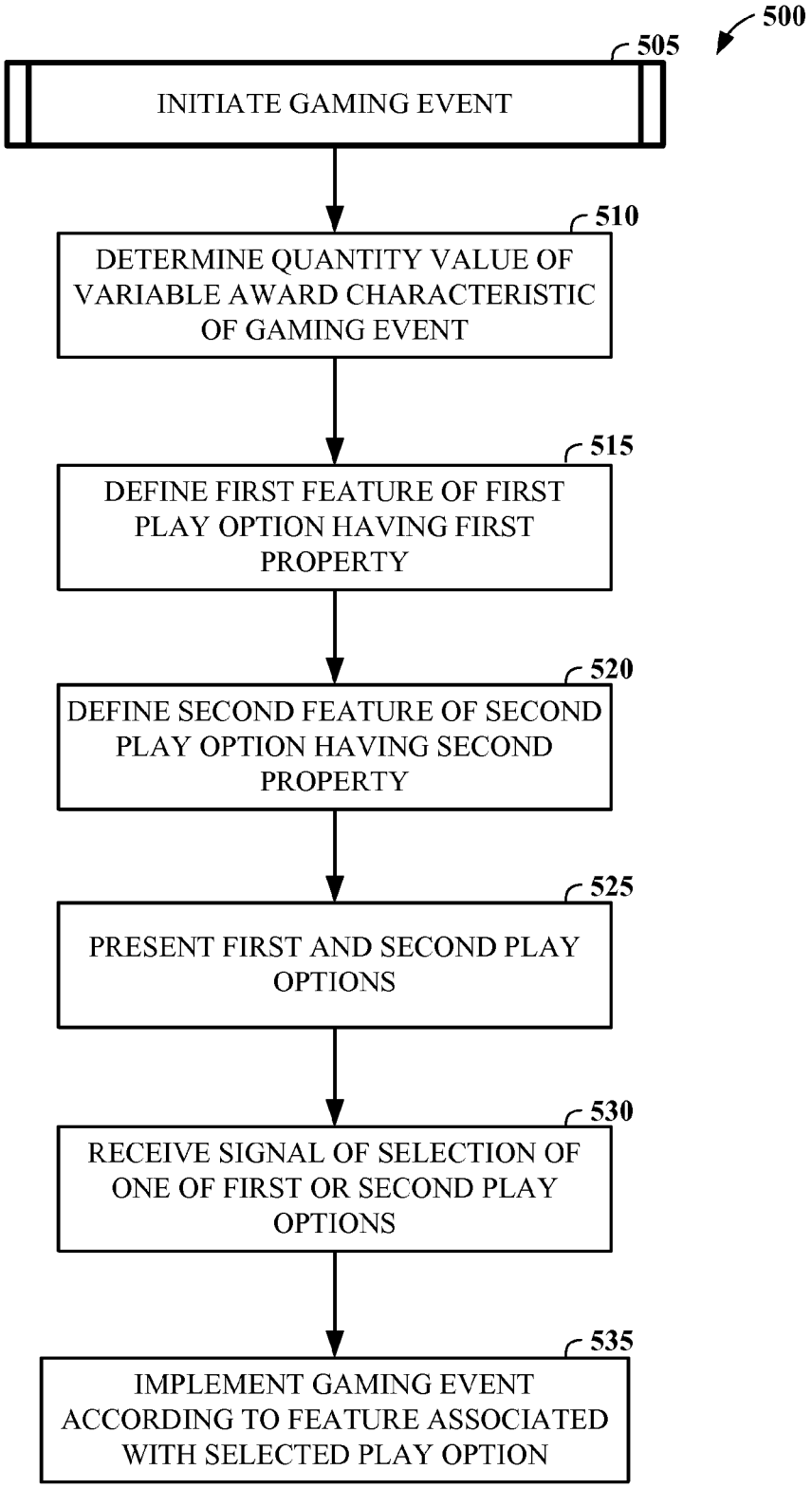
FIG. 5 is a flow diagram of a method of operating a gaming device to allocate variable awards according to embodiments of the invention.
Figure 6:
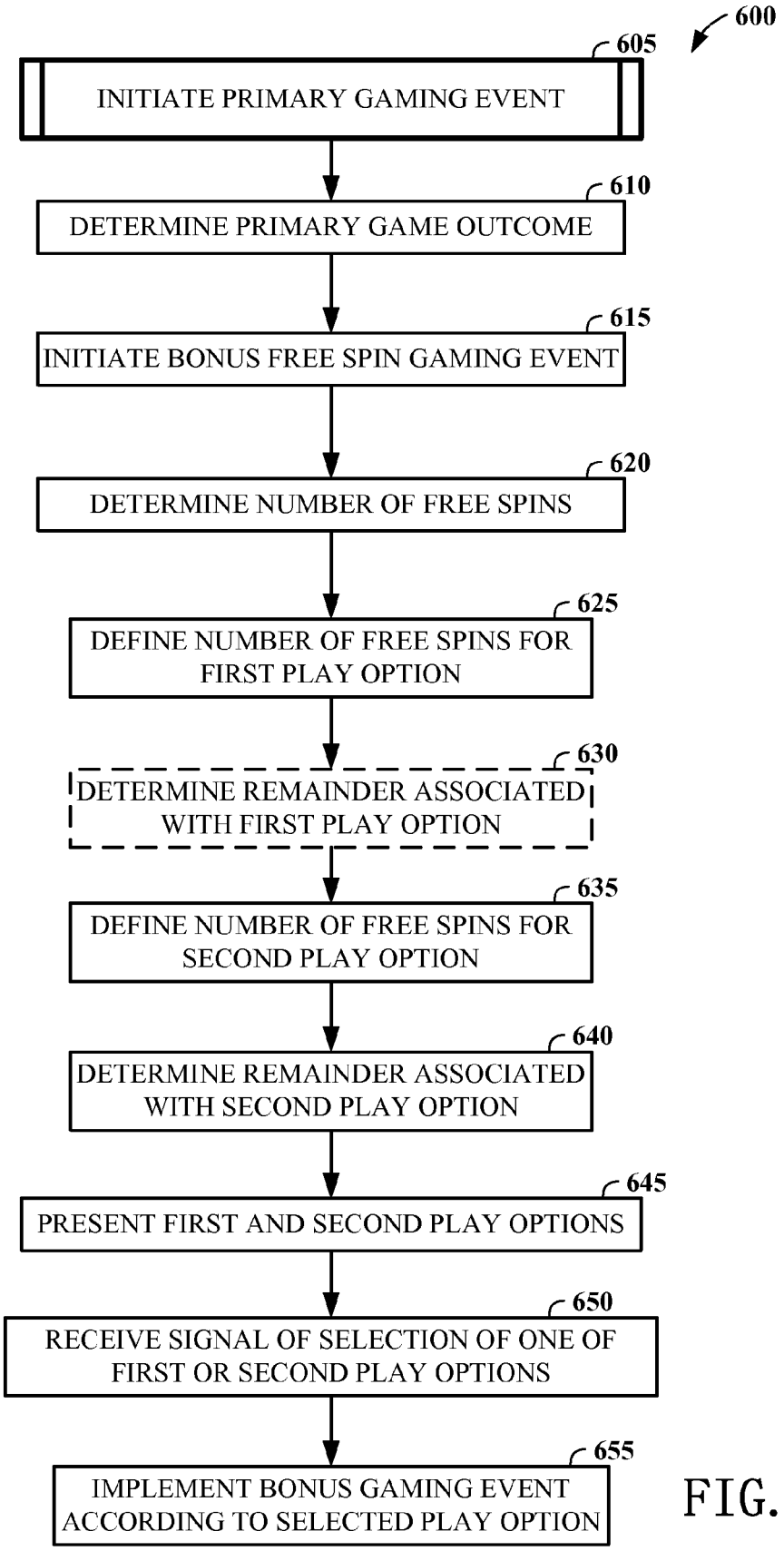
FIG. 6 is a flow diagram of a method of operating a gaming device to allocate variable awards according to embodiments of the invention.

FIGS. 5 and 6 are flow diagrams representing methods in which a gaming device and/or gaming system can be operated according to embodiments of the invention. Although various processes are shown in a particular order in these flow diagrams, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that these example methods are just some embodiments of how the steps of a game operation can be implemented. As discussed and shown above, many variations exist which may require additional, fewer, or different processes to complete.

Referring to FIG. 5, flow 500 begins at process 505 where a gaming event is initiated. As discussed above, this gaming event may be primary or base game event or may be a bonus gaming event. In process 510 a quantity value of a variable award characteristic of a gaming event is determined. Here, the variable award characteristic of the gaming event may be a number of free spins, a number of picks, an amount of a bonus multiplier, a credit range, or another award characteristic that has multiple different possible values. The determined quantity value may be the selected number or amount from within the bounds of the variable award characteristic. For instance, in a free spins award example, a player may win between 10 and 800 free spins depending on the outcomes received in primary base game result. The quantity value of 486 may be directly determined based on the specific outcomes in the primary base game that triggers the free spin bonus event. As described above, the variable award characteristic can take many different forms depending on the structure of the gaming event.

Flow 500 then proceeds to process 515 where a first feature of a first play option having a first property is defined. As with some of the other embodiments described herein, multiple play options may be presented for selection with different properties. The properties may include, for example, multiplier values, special icon values, the presence of specific symbols or groups of symbols, etc. In the above example relating to free spins, a multiplier value may be associated with each of the play options. Hence, if a multiplier value for a first play option is "1×" a first feature of the first play option may simply be defining the number of free spins associated with the first play option, which in this case would be the quantity value of 486 free spins. Similarly in process, 520 a second feature of a second play option having a second property is defined. Here, for example a second property may be a "5×" multiplier associated with the second play option. Hence, the second feature may be defined as 97 free games played with a "5×" multiplier and 1 free game played with a "1×" multiplier.

In process 525, the first and second play options are presented. These play options may be presented as selectable buttons, or associated with selectable indicia on a gaming display associated with the gaming device. A player may then select one of the play options. In process 530 a signal is received indicating a selection of one of the first or second play options. Flow 500 then proceeds to process 535 where the gaming event is implemented with the features associated with the selected play option. Returning the above example, if the player selected the second play option, the gaming device would implement the gaming event to play 97 free spins at "5×" and one free spin at "1×." Although only two play options are described in this flow diagram, three or more play options may be implemented in other embodiments using similar operations.

FIG. 6 illustrates an embodiment using a free spins bonus event with more particular details to illustrate some operations that may be used. Referring to FIG. 6, flow 600 begins at process 605 where a primary gaming event is initiated. In process 610, a game outcome for the primary gaming event may be determined. In process 615, a bonus free spin gaming event is initiated. This bonus free spin gaming event may be triggered by the determined result of primary gaming event, by random, or by another method of triggering a bonus event. Flow 600 then proceeds to process 620 where a number of free spins is determined. The number of free spins may be based on the result of the primary game event, or may be selected at random. As described above, if the number of free spins is based on the result of the primary game event, the triggering event can occur in multiple manners such that the number of awarded free spins is variable rather than static.

In process 625 a number of free spins associated with a first play option is defined. Depending on the features of the first play option the defined number of free spins may simply be the number of free spins determined in process 620. Alternatively, the defined number of free spins may require allocation of the free spins determined in process 620. This allocation may include dividing the number of free spins determined in process 620 by a multiplier associated with the first play option, or another determination used to maintain an expected outcome value for the bonus gaming event.

Optional process 630 may be used to determine a remainder associated with the first play option. Process 630 may not be needed if, for example, the number of free spins associated with the first play option is just set to the number of free spins determined in process 620. Alternatively if dynamic calculations or a table lookup is needed to determine the number of free spins in the first play option, process 630 may be used to determine a remainder value for the first play option, if any.

In process 635, a number of free spins associated with a second play option is defined using similar techniques as described above. Process 640 is used to determine a remainder, if any, associated with the second play option. As described above, a remainder can take many different formats depending on the rules implemented in various gaming embodiments. Thus, remainders may include one or more of extra free spins played at lower multiplier values, extra free spins played with different reels, extra free spins with different award values, etc.

Flow 600 then proceeds to process 645 where the first and second play options are presented on a gaming display. In process 650 a signal is received indicating the selection of the one of the play options displayed in process 645. In process 655, the free spins bonus event is implemented using the rules and features of the selected play option.

Figure 7:
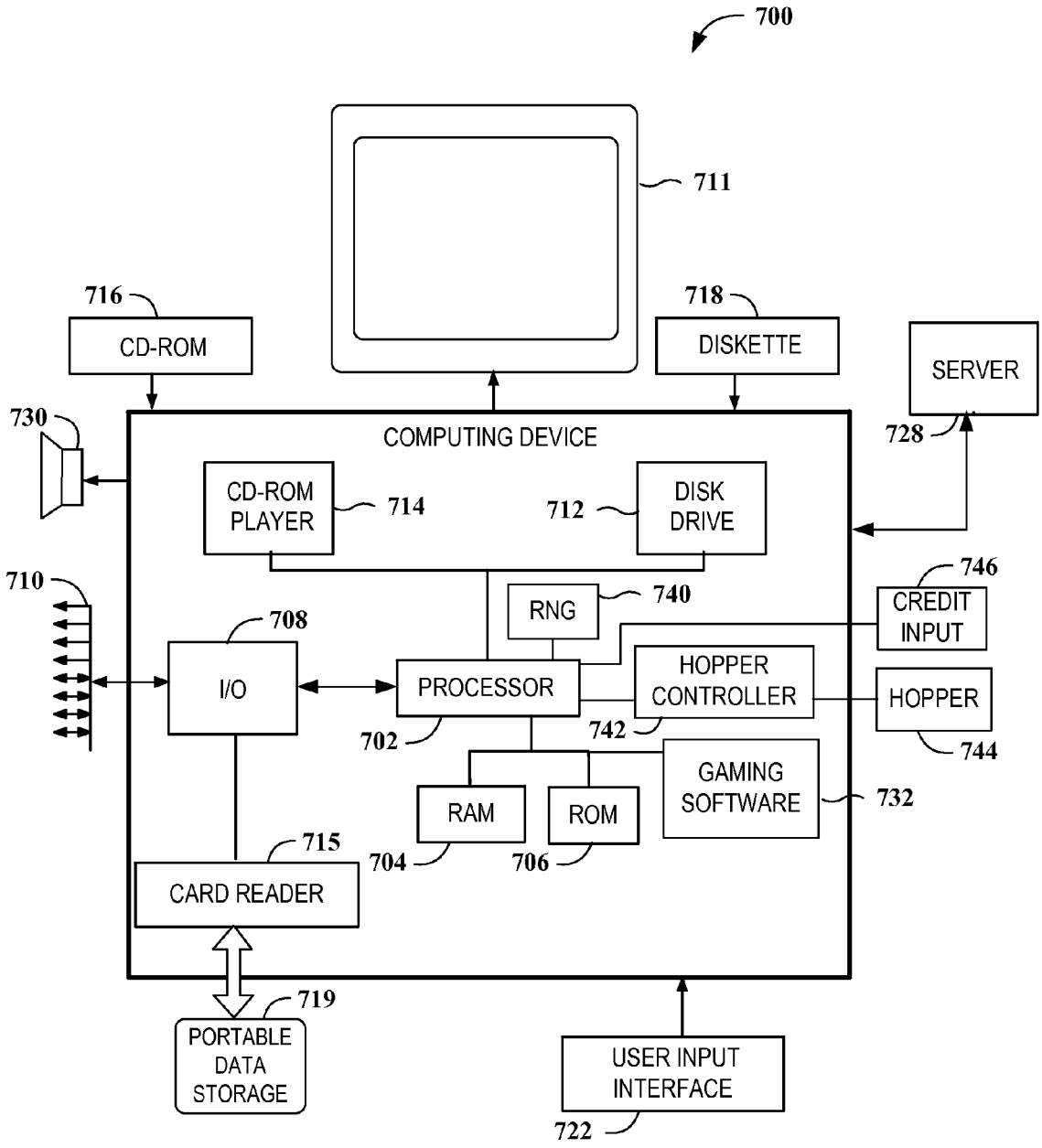
FIG. 7 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 7.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 700 of FIG. 7 is an example computing structure that can be used in connection with such electronic gaming machines, computers, or other computer-implemented devices to carry out operations of the present invention.

The example computing arrangement 700 suitable for performing the gaming functions in accordance with the present invention typically includes a central processor (CPU) 702 coupled to random access memory (RAM) 704 and some variation of read-only memory (ROM) 706. The ROM 706 may also represent other types of storage media to store programs, such as programmable ROM (PROM), erasable PROM (EPROM), etc. The processor 702 may communicate with other internal and external components through input/output (I/O) circuitry 708 and bussing 710, to provide control signals, communication signals, and the like.

The computing arrangement 700 may also include one or more data storage devices, including hard and floppy disk drives 712, CD-ROM drives 714, card reader 715, and other hardware capable of reading and/or storing information such as DVD, etc. In one embodiment, software for carrying out the operations in accordance with the present invention may be stored and distributed on a CD-ROM 716, diskette 718, access card 719, or other form of computer readable media capable of portably storing information. These storage media may be inserted into, and read by, devices such as the CD-ROM drive 714, the disk drive 712, card reader 715, etc. The software may also be transmitted to the computing arrangement 700 via data signals, such as being downloaded electronically via a network, such as the Internet. Further, as previously described, the software for carrying out the functions associated with the present invention may alternatively be stored in internal memory/storage of the computing device 700, such as in the ROM 706.

The computing arrangement 700 is coupled to the display 711, which represents a display on which the gaming activities in accordance with the invention are presented. The display 711 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 700 represents a stand-alone or networked computer, the display 711 may represent a standard computer terminal or display capable of displaying multiple windows, frames, etc. Where the computing device is embedded within an electronic gaming machine, the display 711 corresponds to the display screen of the gaming machine/kiosk. A user input interface 722 such as a mouse, keyboard/keypad, microphone, touch pad, trackball, joystick, touch screen, voice-recognition system, etc. may be provided. The display 711 may also act as a user input device, e.g., where the display 711 is a touchscreen device. In embodiments, where the computing device 700 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 702, or some combination of hardware and software. The present invention is operable using any known RNG, and may be integrally programmed as part of the processor 702 operation, or alternatively may be a separate RNG controller 740.

The computing arrangement 700 may be connected to other computing devices or gaming machines, such as via a network. The computing arrangement 700 may be connected to a network server 728 in an intranet or local network configuration. The computer may further be part of a larger network configuration as in a global area network (GAN) such as the Internet. In such a case, the computer may have access to one or more web servers via the Internet. In other arrangements, the computing arrangement 700 may be configured as an Internet server and software for carrying out the operations in accordance with the present invention may interact with the player via one or more networks. The computing arrangement 700 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 700 may also include a hopper controller 742 to determine the amount of payout to be provided to the participant. The hopper controller may be integrally implemented with the processor 702, or alternatively as a separate hopper controller 742. A hopper 744 may also be provided in gaming machine embodiments, where the hopper serves as the mechanism holding the coins/tokens of the machine. The wager input module 746 represents any mechanism for accepting coins, tokens, coupons, bills, electronic fund transfer (EFT), tickets, credit cards, smart cards, membership/loyalty cards, etc., for which a participant inputs a wager amount. It will be appreciated that the primary gaming software 732 may be able to control payouts via the hopper 744 and controller 742 for independently determined payout events.

Among other functions, the computing arrangement 700 provides an interactive experience to players via input interface 722 and output devices, such as the display 711, speaker 730, etc. These experiences are generally controlled by gaming software 732 that controls a primary gaming activity of the computing arrangement 700. The gaming software 732 may be temporarily loaded into RAM 704, and may be stored locally using any combination of ROM 706, drives 712, media player 714, or other computer-readable storage media known in the art. The primary gaming software 732 may also be accessed remotely, such as via the server 728 or the Internet.

The primary gaming software 732 in the computing arrangement 700 is shown here as an application software module. According to embodiments of the present invention, this software 732 provides a slot game or similar game of chance as described hereinabove. For example, the software 732 may present, by way of the display 711, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 732 may include instructions to provide other functionality as known in the art and described herein, such as shown and described above regarding FIGS. 1-6.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A method of operating a gaming device having a game display, a memory configured to store a credit amount, a wager input device structured to receive physical items associated with a currency value, a game processor, and a player input device, the method comprising:

receiving a signal from the wager input device that a physical item has been received;

incrementing the credit amount in the memory based on the currency value associated with the received physical item;

receiving a signal to initiate a primary gaming event, where a wager associated with the signal to initiate the primary gaming event is deducted from the credit amount stored in the memory;

determining an outcome for the primary gaming event;

receiving a signal to initiate a bonus gaming event;

determining a number of free spin events associated with the bonus gaming event;

defining characteristics of a first play option having a first multiplier, wherein defining characteristics of the first play option includes determining a first number of free spins associated with the first multiplier, and determining a first remainder when the determined number of free spins associated the first multiplier does not evenly divide into the determined number of free spin events associated with the bonus gaming event;

defining characteristics of a second play option having a second multiplier, wherein defining characteristics of the second play option includes determining a second number of free spins associated with the second multiplier, and determining a second remainder when the determined number of free spins associated the second multiplier does not evenly divide into the determined number of free spin events associated with the bonus gaming event;

presenting the first play option and second play option as alternative selectable options on the game display;

receiving a signal indicating a selection of one of the first play option or second play option;

executing the bonus gaming event according to the characteristics of the selected one of the first play option or second play option; and presenting awards associated with the primary gaming event and bonus gaming event, where awards presented increase the credit value stored in the memory.

2. The method of claim 1, wherein the signal to initiate the bonus gaming event is received when the determined outcome of the primary game event satisfies a predetermined criterion.

3. The method of claim 1, wherein the number of free spin events associated with the bonus gaming event is determined based on the determined outcome of the primary game event.

4. The method of claim 1, wherein the number of free spin events associated with the bonus gaming event is determined at random.

5. The method of claim 1, wherein determining the first number of free spins associated with the first multiplier includes setting the first number of free spins to the determined number of free spin events associated with the bonus gaming event.

6. The method of claim 5, wherein the first multiplier is defined as 1×.

7. The method of claim 1, wherein determining the second number of free spins associated with the second multiplier includes dividing the determined number of free spin events associated with the bonus gaming event by the second multiplier.

8. The method of claim 7, wherein determining the second remainder includes:

determining a first remainder number of free spins that were left over after the determined number of free spin events associated with the bonus gaming event was divided by the second multiplier; and defining the second remainder as the first remainder number of free spins to be played at the value of the first multiplier.

9. The method of claim 7, wherein determining the second remainder includes:

determining a second remainder number of free spins that were left over after the determined number of free spin events associated with the bonus gaming event was divided by the second multiplier;

determining an expected outcome value of the second remainder number of free spin events; and providing a credit value as the second remainder.

10. The method of claim 9, wherein providing a credit value as the second remainder includes:

determining a range of values based on the determined expected outcome value of the second remainder number of free spin events; and randomly selecting a credit value from the determined range of values.

11. The method of claim 1, further comprising defining characteristics of a third play option having a third multiplier, wherein defining characteristics of the third play option includes determining a third number of free spins associated with the third multiplier, and determining a third remainder when the determined number of free spins associated the third multiplier does not evenly divide into the determined number of free spin events associated with the bonus gaming event.

12. The method of claim 11, wherein determining the third number of free spins associated with the third multiplier includes dividing the determined number of free spin events associated with the bonus gaming event by the third multiplier.

13. The method of claim 12, wherein determining the third remainder includes:

determining a third remainder number of free spins that were left over after the determined number of free spin events associated with the bonus gaming event was divided by the third multiplier; and defining the third remainder as the third remainder number of free spins to be played at the value of the first multiplier.

14. The method of claim 12, wherein determining the third remainder includes:

determining a fourth remainder number of free spins that were left over after the determined number of free spin events associated with the bonus gaming event was divided by the third multiplier;

determining a fourth number of free spins by dividing the fourth remainder number of free spins by the second multiplier;

determining a fifth remainder number of free spins that were left over after the fourth remainder number of free spins was divided by the second multiplier; and defining the third remainder as the fourth number of free spins to be played at the value of the second multiplier and the fifth remainder number of free spins to be played at the value of the first multiplier.

* * * * *